US006619988B2

(12) United States Patent
Tang

(10) Patent No.: US 6,619,988 B2
(45) Date of Patent: Sep. 16, 2003

(54) CONNECTOR ASSEMBLY

(75) Inventor: James Tang, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/131,740

(22) Filed: Apr. 23, 2002

(65) Prior Publication Data

US 2003/0087553 A1 May 8, 2003

(30) Foreign Application Priority Data

Nov. 2, 2001 (TW) ..... 90218790 U

(51) Int. Cl.[7] ..... H01R 9/03
(52) U.S. Cl. ..... 439/610; 439/578
(58) Field of Search ..... 439/578, 579, 439/580–585, 610

(56) References Cited

U.S. PATENT DOCUMENTS 3,238,494 A * 3/1966 Bentley ..... 439/585
3,372,364 A * 3/1968 O'Keefe et al. ..... 439/585
4,131,332 A * 12/1978 Hogendobler et al. ..... 439/585
5,997,350 A * 12/1999 Burris et al. ..... 439/585
6,095,858 A * 8/2000 Emery ..... 439/578

* cited by examiner

*Primary Examiner*—Hien Vu
(74) *Attorney, Agent, or Firm*—Wei Te Chung

(57) ABSTRACT

A connector assembly includes a cable connector (1), a cable (2), ferrule elements (3) and a conductive contact (4). The cable has a central conductor (21), an insulation layer (23) surrounding the central conductor, a braiding layer (25) surrounding the insulation layer and a cable sheath (27) surrounding the braiding layer. The ferrule elements annularly cover a forward end of the cable, and include an annular insulative first ferrule (31), an annular metal second ferrule (33) and an annular metal third ferrule (35). The first, second and third ferrules engage with the central conductor, the insulation layer and the braiding layer, respectively. The central conductor electrically connects to the contact. The contact and ferrules are inserted into the cable connector. This assembly allows the cable connector to be easily assembled to the cable and provides good electric performance of the cable.

6 Claims, 3 Drawing Sheets

CONNECTOR ASSEMBLY

BACKGROUND OF THE INVENTION

1. Field of the Invention

The present invention generally relates to a connector assembly, and particularly to a connector assembly which easily connects to a thin coaxial cable.

2. Related Art

A conventional connector assembly includes a cable connector and a coaxial cable. The cable has a central conductor, a layer of insulation surrounding the central conductor, a braiding surrounding the layer of insulation, and a cable sheath surrounding the braiding. A forward end of the central conductor projects from a forward end of the insulation. Normally, the braiding is exposed at a forward end of the cable sheath.

The connector assembly further includes a first ferrule and a second ferrule. In assembly, the first and the second ferrules cover the exposed central conductor and the exposed braiding, respectively. Moreover, a portion of the insulation layer needs to be drawn out from beneath the exposed braiding so that the front portion of the braiding layer can be inverted to cover the second ferrule to balance an impedance value of the cable and to ensure electrical performance of the cable.

However, stripping the insulation layer out from beneath the braiding layer of the cable is difficult, especially if the cable is flexible and thin. The braiding layer and the central conductor are both easily damaged during this operation. Such damage can reduce the electrical performance of the cable.

Hence, a connector assembly which uses an improved method to strip a cable is desired to overcome the above problems.

SUMMARY OF THE INVENTION

An object of the present invention is to provide a connector assembly which uses an improved method of stripping a cable to improve the cable assembly efficiency and to ensure good electrical performance of the cable.

Another object of the present invention is to provide a connector assembly which includes a cable connector which has a reversed screw thread on an outer surface thereof to avoid mis-mating with a complementary cable connector.

To achieve the above objects, a connector assembly in accordance with a preferred embodiment of the present invention includes a cable connector, a cable, a plurality of ferrule elements and a conductive contact. The cable has a central conductor, an insulation layer surrounding the central conductor, a braiding layer surrounding the insulation layer and a cable sheath surrounding the braiding layer. The ferrule elements annularly cover a forward end of the cable, and include an annular insulative first ferrule, an annular metal second ferrule and an annular metal third ferrule. The first, second and third ferrules engage with the central conductor, the insulation layer and the braiding layer, respectively, to provide easy stripping of the cable and to maintain good electrical performance of the cable.

These and additional objects, features and advantages of the present invention will become apparent after reading the following detailed description of a preferred embodiment of the invention taken in conjunction with the appended drawings.

DETAILED DESCRIPTION OF THE INVENTION

Figure 1:
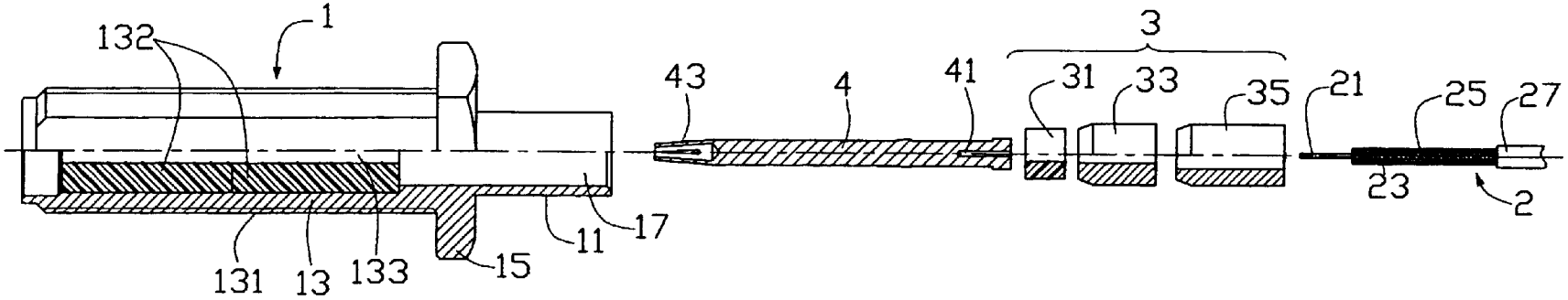
FIG. 1 is an exploded, partly cross-sectional view of a connector assembly according to the present invention.

Referring to FIG. 1, a connector assembly in accordance with a preferred embodiment of the present invention includes a conductive cable connector 1, a cable 2, ferrule elements 3 and a conductive contact 4.

The cable connector 1 includes an annular sleeve 11, a coaxial annular screw 13 and a coaxial annular flange 15, and defines a coaxial bore 17 through the sleeve 11, the screw 13 and the flange 15. The flange 15 is interposed between the sleeve 11 and the screw 13, and has an external diameter far larger than that of the screw 13 or the sleeve 11. The screw 13 forms screw threads 131 on an outer surface thereof. In this embodiment, the screw threads are reversed screw threads to avoid mis-mating of the cable connector 1. Two annular dielectric tubes 132 fit snuggly in the screw 13, in contact with an inner wall of the screw 13 and with each other. Each dielectric tube 132 defines a through-hole 133 in a center thereof to receive the contact 4.

The cable 2 includes a central conductor 21 with an insulation layer 23 surrounding the central conductor 21, a braiding layer 25 surrounding the insulation layer 23 for shielding the central conductor 21, and a cable sheath 27 surrounding the braiding layer 25 for protecting the braiding layer 25. A length of the central conductor 21 projects from a forward end of the insulation layer 23, and a length of the braiding layer 25 projects from a forward end of the cable sheath 27.

Figure 2:
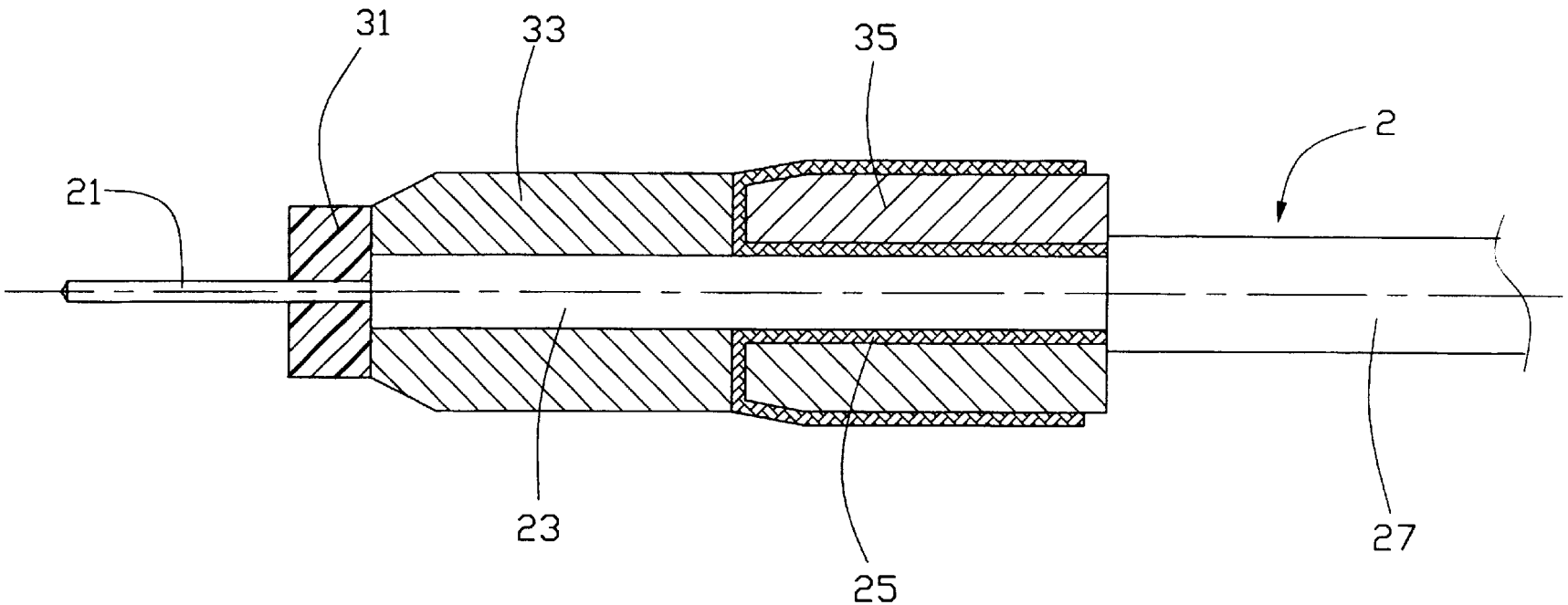
FIG. 2 is a partly cross-sectional view of a cable with ferrule elements of FIG. 1.
Figure 3:
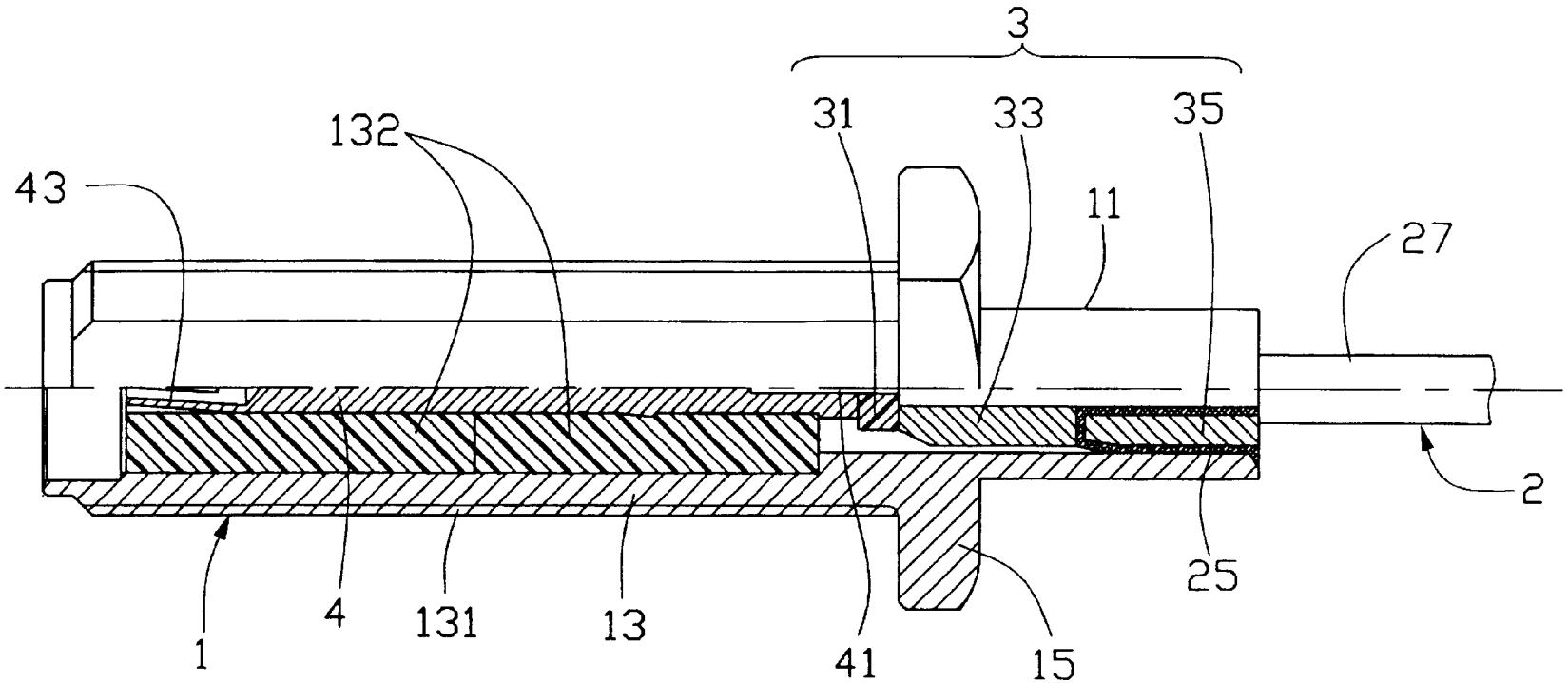
FIG. 3 is a partly cross-sectional, assembled view of the connector assembly of FIG. 1.

The ferrule elements 3 engage with the cable 2 and include an annular insulative first ferrule 31, an annular metal second ferrule 33 and an annular metal third ferrule 35. Referring to FIGS. 2 and 3, in assembly, the ferrule elements 3 annularly cover a front portion of the cable 2. The third ferrule 35 is pressed onto the cable 2 until it covers a rear portion of the exposed braiding layer 25, with a front portion of the braiding layer 25 uncovered and extending out from the third ferrule 35. Then the front portion of the braiding layer 25 is inverted to cover the third ferrule 35, which leaves a length of the insulation layer 23 exposed in front of the braiding layer 25. The second ferrule 33 is then pressed on to the cable 2 until it covers the exposed insulation layer and abuts against the inverted braiding layer 25. The first ferrule 31 is then pressed onto the cable 2 until it abuts against the second ferrule 33 and the insulation layer 23, thereby covering a rear portion of the exposed central conductor 21.

The third ferrule 35 and the second ferrule 33 have the same external diameter to ensure that an impedance value from a core axis of the cable 2 to an outer surface of the second ferrule 33 is equal to an impedance value from the core axis of the cable 2 to an outer surface of the third ferrule 35, thereby ensuring a good electrical performance of the cable 2. An external diameter of the first ferrule 31 is a little smaller than the external diameter of the second ferrule 33.

The contact 4 defines a guiding slot 41 at a rear end thereof and a plughole 43 at a front end thereof. The central conductor 21 of the cable 2 is inserted in the guiding slot 41, with the first ferrule 31 contacting with a rear end of the contact 4 (see FIG. 3). The plughole 43 of the contact 4 can receive a contact of a complementary cable connector (not shown) that is connected to another cable (not shown), thereby electrically connecting the two cables.

Referring to FIG. 3, the cable 2 with the ferrule elements 3 and the contact 4 are inserted into a rear end of the cable connector 1. The contact 4 is inserted into the through-hole 133 of the dielectric tubes 132, and is contained therein. The ferrule elements 3 and the forward end of the cable 2 are contained within the cable connector 1, and the front portion of the braiding layer 25, which covers the third ferrule 35, electrically connects with an inner wall of the sleeve 11 to establish a continuous ground between the cable connector 1 and the braiding layer 25 of the cable 2. Moreover, the contact 4 and the central conductor 21 can be effectively shielded by the cable connector 1, thereby ensuring good electrical performance of the cable.

In comparison with the prior art, the present invention provides a more efficient method of stripping a cable and assembling it to a connector, and effectively avoids damaging the braiding layer and the central conductor during this operation. At the same time, the connector assembly can maintain good electrical performance of the cable.

Although the present invention has been described with reference to a specific embodiment thereof, the description is illustrative and is not to be construed as limiting the invention. Various modifications to the present invention may be made to the preferred embodiment by those skilled in the art without departing from the true spirit and scope of the invention as defined by the appended claims.

I claim:

1. A connector assembly, comprising:

a cable connector;

a conductive contact received in the cable connector;

a cable having a forward end which is received in the cable connector, the cable having a central conductor, an insulation layer surrounding the central conductor, a length of the central conductor projecting from the forward end of the insulation layer and electrically connecting with the contact, a braiding layer surrounding the insulation layer, and a cable sheath surrounding the braiding layer, a length of the braiding layer projecting from a forward end of the cable sheath and thereby being exposed; and ferrule elements annularly covering the forward end of the cable, the ferrule elements including an annular insulative first ferrule, an annular metal second ferrule and an annular metal third ferrule, the third ferrule surrounding a rear portion of the exposed braiding layer, a front portion of the exposed braiding layer which extends out from a front of the third ferrule being inverted to cover the third ferrule thereby leaving the insulation layer previously covered by the front portion of the braiding layer exposed, the second ferrule covering the exposed insulation layer and abutting against the inverted braiding layer, and the first ferrule surrounding a rear portion of the exposed central conductor and abutting against a front end of the second ferrule and the exposed insulation layer; wherein the cable connector further comprises a coaxial annular screw extending forward from a sleeve; wherein the screw forms reversed screw threads on an outer surface thereof; wherein the screw has at least one annular dielectric tube located therein and fitting against an inner wall of the screw and the at least one dielectric tube defines a through-hole therein.

2. The connector assembly as claimed in claim 1, wherein the second ferrule and the third ferrule have a same external diameter.

3. The connector assembly as claimed in claim 1, wherein the contact is inserted into the through-hole.

4. The connector assembly as claimed in claim 3, wherein the contact defines a guiding slot to receive the central conductor.

5. The connector assembly as claimed in claim 1, wherein the cable connector further includes a coaxial annular flange, the flange being interposed between the sleeve and the screw, and the flange having an external diameter far larger than that of the screw or the sleeve.

6. A method for connecting a cable to a cable connector having a reversed screw threads on an outer surface thereof, comprising the steps of:

(1) providing a cable having a central conductor, an insulation layer surrounding the central conductor, a braiding layer surrounding the insulation layer and a cable sheath surrounding the braiding layer;

(2) providing ferrule elements including an insulative first ferrule, a metal second ferrule and a metal third ferrule;

(3) providing a conductive contact;

(4) stripping a front end of the cable sheath off the cable to expose a section of the braiding layer, and stripping a front portion of the exposed braiding layer and a same length of the insulation layer to expose a section of the central conductor;

(5) mounting the third ferrule on the cable to surround a rear portion of a remaining, exposed braiding layer and to contact with a front end of the cable sheath;

(6) inverting a remaining, exposed braiding layer which projects to a front of the third ferrule to cover the third ferrule, thereby exposing a section of the insulation layer;

(7) mounting the second ferrule on the cable to surround the exposed insulation layer and abuts the braiding layer;

(8) mounting the first ferrule on the cable to surround a rear portion of the exposed central conductor and to abut a front end of the insulation layer and the second ferrule;

(9) connecting the conductive contact with the central conductor,

(10) inserting the contact and the cable with the ferrule elements into the cable connector.

* * * * *